US012721375B2

(12) United States Patent
Li et al.

(10) Patent No.: US 12,721,375 B2
(45) Date of Patent: Sep. 1, 2026

(54) AEROSOL-PRODUCING APPARATUS AND CONTROL METHOD THEREFOR

(71) Applicant: SHENZHEN FIRST UNION TECHNOLOGY CO., LTD., Shenzhen (CN)

(72) Inventors: Xinjun Li, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 680 days.

(21) Appl. No.: 18/256,213

(22) PCT Filed: Dec. 8, 2021

(86) PCT No.: PCT/CN2021/136481

§ 371 (c)(1),
(2) Date: Jun. 7, 2023

(87) PCT Pub. No.: WO2022/121946

PCT Pub. Date: Jun. 16, 2022

(65) Prior Publication Data

US 2024/0099376 A1 Mar. 28, 2024

(30) Foreign Application Priority Data

Dec. 8, 2020 (CN) ..... 202011442673.4

(51) Int. Cl.
*A24F 40/465* (2020.01)
*A24F 40/20* (2020.01)
*A24F 40/50* (2020.01)

(52) U.S. Cl.
CPC ..... *A24F 40/465* (2020.01); *A24F 40/20* (2020.01); *A24F 40/50* (2020.01)

(58) Field of Classification Search
None
See application file for complete search history.

(56) References Cited

U.S. PATENT DOCUMENTS

2005/0258826 A1 11/2005 Kano et al.
2010/0181306 A1* 7/2010 Gutierrez ..... H05B 6/062 219/660

(Continued)

FOREIGN PATENT DOCUMENTS

CN 1334643 A 2/2002
CN 103163764 A 6/2013

(Continued)

*Primary Examiner* — Edward F Landrum
*Assistant Examiner* — Theodore J Evangelista
(74) *Attorney, Agent, or Firm* — PROI Intellectual Property US

(57) ABSTRACT

An embodiment of this application provides an aerosol generation device, configured to heat an aerosol generation product to generate aerosols for inhalation. The device includes: a susceptor, configured to be penetrated by a variable magnetic field to generate heat, to heat the aerosol generation product; a series LC oscillator or a series LCC oscillator including an inductance coil, configured to guide a variable alternating current to flow through the inductance coil to drive the inductance coil to generate the variable magnetic field; and a circuit, configured to determine an oscillation frequency of the series LC oscillator or the series LCC oscillator according to a change rate of an oscillation voltage of the series LC oscillator or the series LCC oscillator. According to the foregoing aerosol generation device, the oscillation frequency is determined according to the change rate of the oscillation voltage.

17 Claims, 5 Drawing Sheets

(56) References Cited

U.S. PATENT DOCUMENTS

| | | | | |
|---|---|---|---|---|
| 2019/0200677 | A1 | 7/2019 | Chong et al. | |
| 2020/0037402 | A1* | 1/2020 | Abi Aoun | H05B 6/06 |
| 2020/0146353 | A1* | 5/2020 | Liu | A24F 40/50 |
| 2022/0183390 | A1* | 6/2022 | Beidelman | A24F 40/50 |
| 2024/0023621 | A1* | 1/2024 | Li | A24F 40/465 |
| 2024/0032605 | A1* | 2/2024 | Liu | A24F 40/20 |

FOREIGN PATENT DOCUMENTS

| | | | |
|---|---|---|---|
| CN | 105992528 | B | 10/2016 |
| CN | 107727927 | A | 2/2018 |
| CN | 109890233 | A | 6/2019 |
| CN | 110476478 | A | 11/2019 |
| CN | 112039341 | A | 12/2020 |
| EP | 3603333 | A2 | 2/2020 |
| JP | 2007026906 | A | 2/2007 |
| JP | 2020512662 | A | 4/2020 |
| KR | 20200089723 | A | 7/2020 |
| WO | 2020182731 | A1 | 9/2020 |
| WO | 2020183162 | A1 | 9/2020 |

* cited by examiner

AEROSOL-PRODUCING APPARATUS AND CONTROL METHOD THEREFOR

CROSS-REFERENCE TO RELATED APPLICATIONS

This application claims priority to Chinese Patent Application No. 202011442673.4, filed with the China National Intellectual Property Administration on Dec. 8, 2020 and entitled "AEROSOL GENERATION DEVICE AND CONTROL METHOD THEREOF", which is incorporated herein by reference in its entirety.

TECHNICAL FIELD

Embodiments of this application relate to the field of heat not burn cigarette device technologies, and in particular, to an aerosol generation device and a control method thereof.

BACKGROUND

Tobacco products (such as cigarettes, cigars, and the like) burn tobacco during use to produce tobacco smoke. Attempts are made to replace these tobacco-burning products by making products that release compounds without burning.

An example of this type of products is a heating apparatus that releases compounds by heating rather than burning materials. For example, the materials may be tobacco or other non-tobacco products. These non-tobacco products may include or not include nicotine. In known apparatuses, a heater that generates heat through electromagnetic induction heats a tobacco product to generate aerosols for inhalation. In an embodiment of the heating apparatus in the related art, patent No. 201580007754.2 proposes an induction heating apparatus that heats purpose-made cigarette products through electromagnetic induction. Specifically, an alternating current is formed by connecting an induction coil and a capacitor in series or in parallel to form LC oscillation, so that the coil generates an alternating magnetic field to induce a susceptor to generate heat, so as to heat the cigarette product. In the foregoing known heating apparatuses, an operational amplifier is generally used to synchronously output an oscillation voltage of LC oscillation or detect a zero-crossing time of an oscillation voltage through a zero-crossing comparator, and a control chip then calculates an LC oscillation frequency by sampling the foregoing result. During an implementation, the LC oscillation frequency is very high and ranges approximately from 200 KHz to 400 KHz, and sampling needs to be performed by the control chip when the comparator and the amplifier output results instantaneously, so that a sampling speed of the control chip needs to be about dozens of MHz to prevent result signals instantaneously outputted by the comparator or the amplifier from being missed. Therefore, it is not feasible to track the LC oscillation frequency in this manner.

SUMMARY

An embodiment of this application provides an aerosol generation device, configured to heat an aerosol generation product to generate aerosols for inhalation, including:

a susceptor, configured to be penetrated by a variable magnetic field to generate heat, to heat the aerosol generation product;

a series LC oscillator or a series LCC oscillator including an inductance coil, configured to guide a variable alternating current to flow through the inductance coil to drive the inductance coil to generate the variable magnetic field; and a circuit, configured to determine an oscillation frequency of the series LC oscillator or the series LCC oscillator according to a change rate of an oscillation voltage of the series LC oscillator or the series LCC oscillator. According to the foregoing aerosol generation device, the oscillation frequency is determined according to the change rate of the oscillation voltage.

In a preferred implementation, the circuit includes:

an active differential unit, configured to detect the change rate of the oscillation voltage of the series LC oscillator or the series LCC oscillator, and output a high-level signal when the change rate of the oscillation voltage is greater than a preset threshold; and a controller, configured to determine the oscillation frequency of the series LC oscillator or the series LCC oscillator according to an interval of the high-level signal.

In a preferred implementation, the active differential unit includes: an active differential module and a comparator, where the active differential module is configured to detect the change rate of the oscillation voltage of the series LC oscillator or the series LCC oscillator; and the comparator is configured to perform comparison operation on the change rate of the oscillation voltage and the preset threshold, and output the high-level signal to the controller when the change rate of the oscillation voltage is greater than the preset threshold.

In a preferred implementation, the active differential module includes: a first capacitor, a first resistor, a second capacitor, a second resistor, and an operational amplifier, where a first end of the first capacitor is connected to the series LC oscillator or the series LCC oscillator, and a second end of the first capacitor is connected to a first end of the first resistor;

a first input end of the operational amplifier is connected to a second end of the first resistor, and an output end of the operational amplifier is connected to the comparator;

a first end of the second capacitor is connected to the second end of the first resistor, and a second end of the second capacitor is connected to the output end of the operational amplifier; and a first end of the second resistor is connected to the second end of the first resistor, and a second end of the second resistor is connected to the output end of the operational amplifier.

In a preferred implementation, the active differential unit further includes:

an access module, including a first diode, a third resistor, and a fourth resistor, where a first end of the first diode is connected to the series LC oscillator or the series LCC oscillator, and a second end of the first diode is connected to a first end of the third resistor and is configured to only allow a current to flow from the series LC oscillator or the series LCC oscillator to the third resistor;

a second end of the third resistor is connected to the active differential module; and a first end of the fourth resistor is connected to the second end of the third resistor, and a second end of the fourth resistor is connected to the ground.

In a preferred implementation, the access module further includes a voltage stabilizing tube, where a first end of the voltage stabilizing tube is connected to the second end of the third resistor, and a second end of the voltage stabilizing tube is connected to the second end of the fourth resistor.

In a preferred implementation, the preset threshold is an output value of the active differential module when the change rate of the oscillation voltage is 0.

In a preferred implementation, the controller is configured to adjust the oscillation frequency of the series LC oscillator or the series LCC oscillator, to cause the oscillation frequency of the series LC oscillator or the series LCC oscillator to be equal to or basically close to a preset frequency.

Another embodiment of this application further provides an aerosol generation device control method, the aerosol generation device including:

- a susceptor, configured to be penetrated by a variable magnetic field to generate heat, to heat an aerosol generation product; and
- a series LC oscillator or a series LCC oscillator including an inductance coil, configured to guide a variable alternating current to flow through the inductance coil to drive the inductance coil to generate the variable magnetic field; and the method including:

- detecting a change rate of an oscillation voltage of the series LCC oscillator or the series LC oscillator;
- generating a high-level signal when the change rate of the oscillation voltage is greater than a preset value; and
- determining an oscillation frequency of the series LCC oscillator or the series LC oscillator according to an interval of the high-level signal.

In a preferred implementation, the method further includes:

- adjusting the oscillation frequency of the series LC oscillator or the series LCC oscillator, to cause the oscillation frequency of the series LC oscillator or the series LCC oscillator to be equal to or basically close to a preset frequency.

BRIEF DESCRIPTION OF THE DRAWINGS

One or more embodiments are exemplarily described with reference to the corresponding FIGURES in the accompanying drawings, and the descriptions do not constitute a limitation to the embodiments. Components in the accompanying drawings that have same reference numerals are represented as similar components, and unless otherwise particularly stated, the figures in the accompanying drawings are not drawn to scale.

DETAILED DESCRIPTION

For ease of understanding of this application, this application is described in more detail below with reference to the accompanying drawings and specific implementations.

Figure 1:
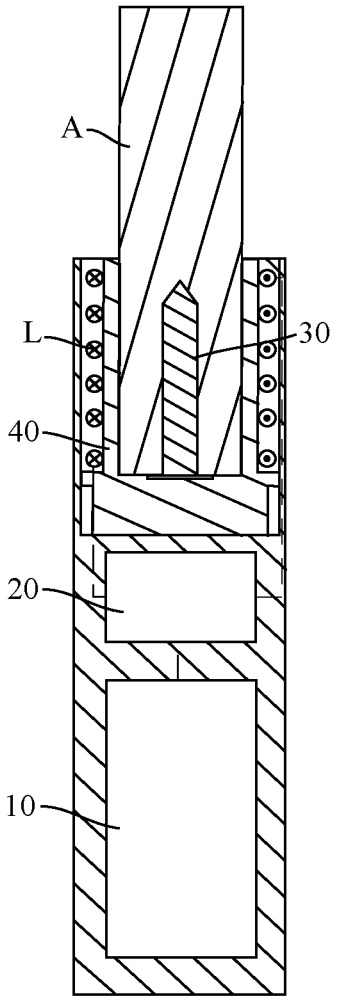
FIG. 1 is a schematic structural diagram of an aerosol generation device according to an embodiment of this application.

An embodiment of this application provides an aerosol generation device whose structure may refer to FIG. 1, including:

- a chamber, where an aerosol generation product A is removably received in the chamber;
- an inductance coil L, configured to generate a variable magnetic field under an alternating current;
- a susceptor 30, where at least a part of the susceptor extends in the chamber, and the susceptor is configured to be inductively coupled to the inductance coil L and be penetrated by the variable magnetic field to generate heat, to heat the aerosol generation product A such as a cigarette, so that at least one component of the aerosol generation product A is volatilized, to form aerosols for inhalation;
- a cell 10, being a rechargeable direct current cell, and configured to output a direct current; and
- a circuit 20, connected to the rechargeable cell 10 through a suitable current, and configured to convert the direct current outputted by the cell 10 into an alternating current with a suitable frequency and supply the alternating current to the inductance coil L.

According to settings used in a product, the inductance coil L may include a cylindrical inductor coil wound into a spiral shape, as shown in FIG. 1. The cylindrical inductance coil L wound into the spiral shape may have a radius r ranging from about 5 mm to about 10 mm, and the radius r specifically may be about 7 mm. The cylindrical inductance coil L wound into the spiral shape may have a length ranging from about 8 mm to about 14 mm, and a number of turns of the inductance coil L may range from 8 to 15. Correspondingly, an inner volume may range from about 0.15 cm 3 to about 1.10 $cm^3$.

In a more preferred implementation, the frequency of the alternating current supplied by the circuit 20 to the inductance coil L ranges from 80 KHz to 400 KHz; and more specifically, the frequency may approximately range from 200 KHz to 300 KHz.

In a preferred embodiment, a direct current supply voltage provided by the cell 10 ranges from about 2.5 V to about 9.0 V, and an amperage of the direct current that the cell 10 can provide ranges from about 2.5 A to about 20 A.

In a preferred embodiment, the susceptor 30 is in a shape of a pin or a blade in general, which is conducive to insertion into the aerosol generation product A. In addition, the susceptor 30 may have a length of about 12 mm, a width of about 4 mm, and a thickness of about 0.5 mm, and may be made of stainless steel of level 430 (SS430). In an alternative embodiment, the susceptor 30 may have a length of about 12 mm, a width of about 5 mm, and a thickness of about 0.5 mm, and may be made of stainless steel of level 430 (SS430). In other variant embodiments, the susceptor 30 may be constructed as a cylindrical or tubular shape; and an internal space of the susceptor during use forms the chamber configured to receive the aerosol generation product A, and the aerosols for inhalation are generated in a manner of heating an outer periphery of the aerosol generation product A. The susceptor may also be made of stainless steel of level 420 (SS420) and an alloy material (such as permalloy) containing iron/nickel.

In an embodiment shown in FIG. 1, the aerosol generation device further includes a holder 40 configured to arrange the inductance coil L and the susceptor 30, and a material of the holder 40 may include a non-metal material with high temperature resistance such as PEEK or ceramic. During implementations, the inductance coil L is fixed on an outer wall of the holder 40 in a winding manner. In addition, as shown in FIG. 1, the holder 40 is in a shape of a hollow tube, and some space of the hollow tube forms the chamber configured to receive the aerosol generation product A.

In an optional implementation, the susceptor 30 is made of a susceptive material, or obtained by forming a susceptive material coating on an outer surface of a heat-resistant substrate material such as ceramic through plating or deposition.

Figure 2:
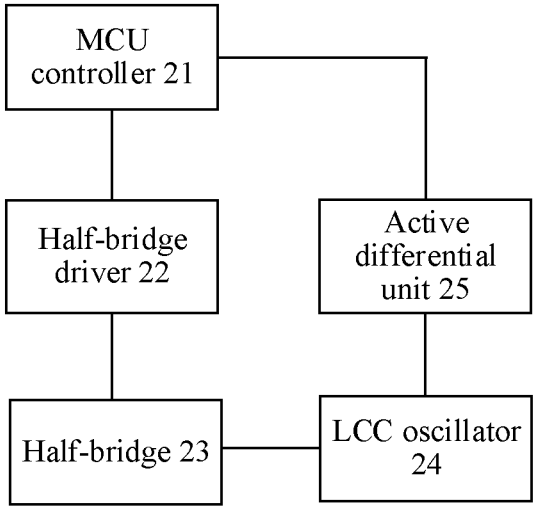
FIG. 2 is a structural block diagram of a circuit in FIG. 1 according to an embodiment.
Figure 3:
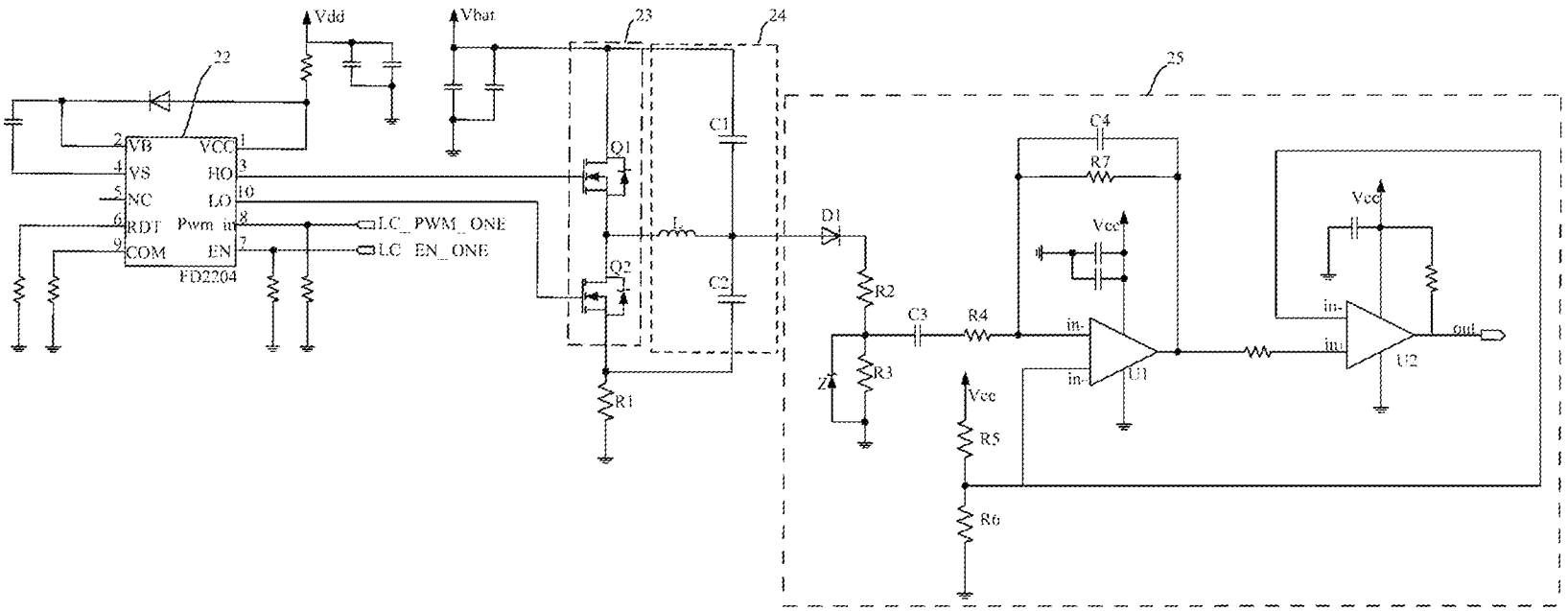
FIG. 3 is a schematic diagram of basic components of the circuit in FIG. 2 according to an embodiment.

For a structure and basic components of the circuit 20 in a preferred implementation, reference may be made to FIG. 2 and FIG. 3, including:

an LCC oscillator 24, where the LCC oscillator 24 includes the inductance coil L, a first capacitor C1, and a second capacitor C2; and the LCC oscillator 24 is configured to generate an alternating current flowing through the inductance coil L during oscillation, to cause the inductance coil L to generate an alternating magnetic field to induce the susceptor 30 to generate heat;

a half-bridge 23, being a half-bridge circuit including transistor switches, where the half-bridge includes a switch tube Q1 and a switch tube Q2, and is configured to perform alternate switching between turn-on and turn-off to cause the LCC oscillator 24 to oscillate; and a half-bridge driver 22, configured to control the switch tube Q1 and the switch tube Q2 of the half-bridge 23 to be alternately turned on and turned off according to a control signal of an MCU controller 21.

For a complete connection manner and a detailed oscillation process of the LCC oscillator 24 in the foregoing embodiment, reference may be made to FIG. 3. Specifically:

In term of connection, a first end of the first capacitor C1 is connected to a positive electrode of the cell 10, and a second end of the first capacitor is connected to a first end of the second capacitor C2; a second end of the second capacitor C2 is connected to the ground through a resistor R1;

a first end of the switch tube Q1 of the half-bridge 23 is connected to the positive electrode of the cell 10, a second end of the switch tube Q1 is connected to a first end of the switch tube Q2, and a second end of the switch tube Q2 is connected to the ground through the resistor R1, where certainly, controlled ends of the switch tube Q1 and the switch tube Q2 are both connected to the half-bridge driver 22, so that the switch tubes are turned on and turned off under driving of the half-bridge driver 22; and a first end of the inductance coil L is connected to the second end of the switch tube Q1, and a second end of the inductance coil L is connected to the second end of the first capacitor C1. In addition, in term of hardware selection of the LCC oscillator 24, maximum voltage values of the first capacitor C1 and the second capacitor C2 are far greater than an output voltage value of the cell 10. For example, in a general implementation, a used output voltage of the cell 10 is basically about 4 V, and used maximum voltages of the first capacitor C1 and the second capacitor C2 range from 30 V to 80 V.

According to the LCC oscillator 24 in the foregoing structure, in state switching of the switch tube Q1 and the switch tube Q2, connection states between the first capacitor C1 and the second capacitor C2 with the inductance coil L are variable. Specifically, in FIG. 3, when the switch tube Q1 is turned on and the switch tube Q2 is turned off, the first capacitor C1 and the inductance coil L jointly form a closed series LC loop, and the second capacitor C2 and the inductance coil L form a series LC loop with two ends respectively connected to positive and negative electrodes of the cell 10. When the switch tube Q1 is turned off and the switch tube Q2 is turned on, formed loops are reverse to the foregoing states, the first capacitor C1 and the inductance coil L form a series LC loop with two ends respectively connected to the positive and negative electrodes of the cell 10, and the second capacitor C2 and the inductance coil L jointly form a closed series LC loop. Under different states, the first capacitor C1 and the second capacitor C2 can both form respective LC loops with the inductance coil L. However, in the respective LC loops during oscillation, directions and periods of generated currents flowing through the inductance coil L are the same, and the currents jointly form an alternating current flowing through the inductance coil L.

Figure 4:
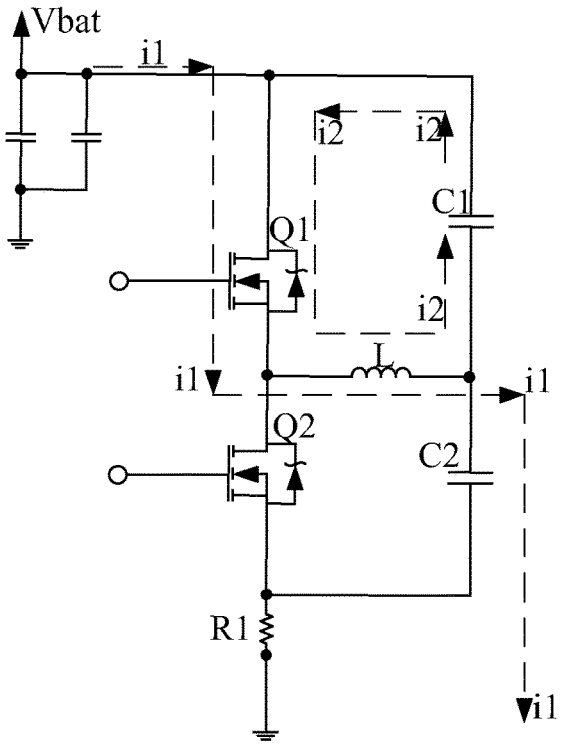
FIG. 4 is a schematic diagram of a forward current in a stage of an LCC oscillator in FIG. 3.

Specifically, steps for controlling an oscillation process having the foregoing LCC oscillator 24 are different from those for a conventional series or parallel LC oscillator. Further, in a preferred implementation of this application, a complete oscillation process of the LCC oscillator 24 is described by using switching actions of the switch tube Q1 and the switch tube Q2. The process includes:

S10. The switch tube Q1 is turned on, and the switch tube Q2 is kept in a turn-off state. In this state, the LCC oscillator 24 completes the following two processes. Specifically:

S11. As shown in FIG. 4, when the switch tube Q1 is turned on and the switch tube Q2 is turned off, the cell 10 charges the second capacitor C2 through a current i1, and the first capacitor C1 is discharged through a current i2. In this process, a current flowing from left to right through the inductance coil L shown in FIG. 4 is formed, which may be denoted as a current in a forward direction. In the stage S11, when the first capacitor C1 is turned on by the switch tube Q1, discharging is started until a voltage difference on two ends is 0 to complete discharging, and charging is ended when voltages on two ends of the second capacitor C2 are increased to be equal to the output voltage of the cell 10. In this case, the current through the inductance coil L reaches a resonant peak value.

S12. After the stage S11 is completed, the state that the switch tube Q1 is turned on and the switch tube Q2 is turned off is kept, the inductance coil L discharges in a direction same as the current i2 in FIG. 1 to charge the first capacitor C1, so that the current flowing through the inductance coil L in the forward direction is gradually decreased until the current through the inductance coil L is discharged to 0. In this stage, because the first capacitor C1 is completely discharged in the stage S11, and a loop formed by the inductance coil L and the first capacitor C1 through the switch tube Q1 basically has no impedance, in the stage S12, the inductance coil L mainly discharges to charge the first capacitor C1, and a current flowing through the inductance coil L during discharging is the same as the current i2 in the stage S11. In the stage S11, the second capacitor C2 has been basically charged to be equal to the output voltage of the cell 10. Therefore, in the stage S12, the inductance coil L may slightly compensate the second capacitor C2, but the compensation may be basically ignored.

In complete processes of the stage S11 and the stage S12, a total current flowing through the inductance coil L is increased from 0 to a maximum value in the forward direction, and is then gradually decreased to 0 through discharging of the inductance coil L, where a direction of the current flowing through the inductance coil L is always in the forward direction from left to right.

Figure 5:
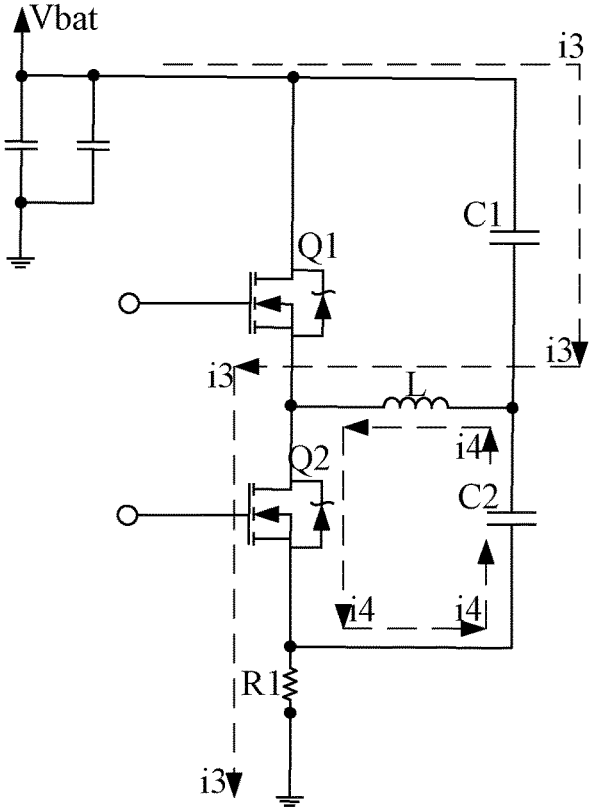
FIG. 5 is a schematic diagram of a reverse current in a stage of the LCC oscillator in FIG. 3.

S20. After step S10 is completed, the switch tube Q1 is turned off and the switch tube Q2 is turned on, to complete processes of the two following stages. Specifically:

S21. Starting from the turn-on of the switch tube Q2, loops of a current i3 and a current i4 shown in FIG. 5 are generated in the LCC oscillator 24. According to current paths shown in FIG. 5, the current i3 flows from the positive electrode of the cell 10 through the first capacitor C1, the inductance coil L, and the switch tube Q2 sequentially to the negative electrode of the cell 10 by being connected to the ground to form a loop; and at the same time, the current i4 flows from a positive end of the second capacitor C2 through the inductance coil L and the switch tube Q2 in an anti-clockwise direction shown in the figure to a negative end of the second capacitor C2 to form a loop. In this process, a current flowing through the inductance coil L from right to left shown in FIG. 5 is formed, which is opposite to the current direction in FIG. 4 and may be denoted as a current in a reverse direction.

In the stage S21, the first capacitor C1 is charged and the second capacitor C2 is discharged simultaneously. When a voltage of the first capacitor C1 is increased to be equal to the output voltage of the cell 10 and a voltage difference on two ends of the second capacitor C2 is 0, the current through the inductance coil L reaches a resonant peak value.

S22. After the stage S21 is completed, the switch tube Q2 is kept to be turned on, the inductance coil L reversely charges the second capacitor C2, so that the current flowing through the inductance coil L in the reverse direction is gradually decreased until the current through the inductance coil L is discharged to 0.

In complete processes of the stage S21 and the stage S22 in step S20, a total current flowing through the inductance coil L is also increased from 0 to a maximum value in the reverse direction, and is then gradually decreased to 0 through discharging of the inductance coil L.

Figure 6:
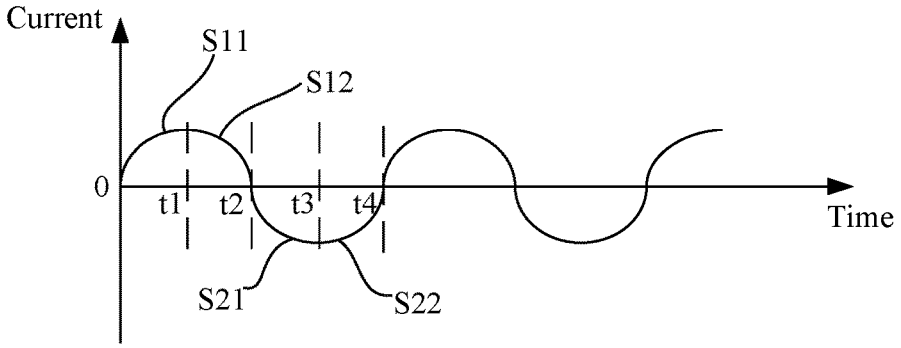
FIG. 6 is a schematic diagram of a resonant current of the series LCC oscillator in FIG. 3.

Therefore, during oscillation of the LCC oscillator 24, for changes of the current flowing through the inductance coil L, reference may be made to FIG. 6, and a complete current period includes four parts in FIG. 6 respectively corresponding to the stages S11/S12/S21/S22. In step S10 and step S20, turn-on and turn-off states of the switch tube Q1 and the switch tube Q2 are switched circularly and alternately, so that the oscillation process of the stages S11/S12/S21/S22 may be generated in the LCC oscillator 24 circularly, to form an alternating current flowing through the inductance coil L.

Therefore, as can be seen based on the foregoing control process, the LCC oscillator 24 in this applications forms inversion according to a zero current switch (ZCS) inverter topology, which is different from a zero voltage switch (ZVS) inverter topology of existing LC oscillators. In addition, the switch tube Q1 and the switch tube Q2 are configured to perform turn-on/turn-off switching when the current flowing through the inductance coil L is 0.

In the preferred implementation shown in FIG. 3, a quantity of the first capacitors C1 and a quantity of the second capacitors C2 are both 1. In other optional implementations, the first capacitor C1 or the second capacitor C2 may each include 2 or 3 capacitors connected in parallel with smaller capacitance values. For example, when the first capacitor C1 uses a plurality of small capacitors to replace an originally required large capacitor, total capacitance values thereof are the same or approximately the same. Each of the small capacitors may correspondingly present greatly decreased and variable equivalent series resistance (ESR) when compared with a single capacitor along with changes of an oscillation frequency of the LCC oscillator 24. Specifically, when the oscillation frequency is low, the ESR is relatively high, and when the oscillation frequency is high, the ESR is relatively low, which may be conducive to prevent a spike. In addition, using the plurality of small capacitors to replace the originally required large capacitor is conducive to reduce a resonant frequency of the LCC oscillator 24.

By using the circuit 20 of the LCC oscillator 24, inversion is formed by using a ZCS technology during implementations, which basically has a half resonant frequency when compared with LC series/parallel oscillation of a single capacitor. Generally, when an LC series/parallel oscillation frequency is about 380 Hz, the oscillation frequency of the LCC oscillator 24 is about 190 KHz, which is conducive to synchronous detection and control of the MCU controller 21.

Figure 7:
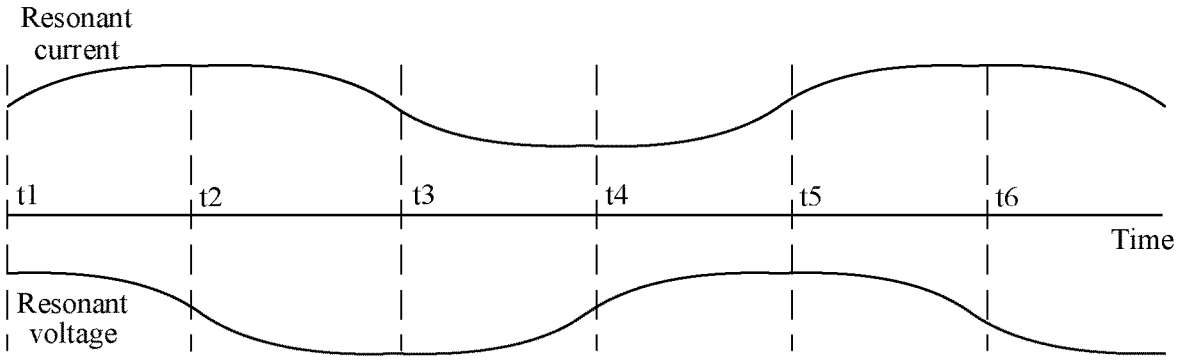
FIG. 7 is a schematic diagram of changes of a tested resonant current and a tested resonant voltage of the series LCC oscillator in FIG. 3.

In addition, in the foregoing oscillation process, changes of a resonant voltage and a resonant current of the LCC oscillator 24 obtained through detection are shown in FIG. 7. The resonant voltage is approximately previous to the resonant current for about ¼ period, and the entire LCC oscillator 24 is weak inductive. "Capacitive" and "inductive" are electrical terms related to a series and parallel circuit (for example, the LCC oscillator or the LCC oscillator 24) of an electronic device. When the capacitance of the series and parallel circuit is greater than the inductance, the circuit is capacitive, and when the inductance is greater than the capacitance, the circuit is inductive. The state of "weak inductive" refers to a state that the inductance and the capacitance are basically equal and the inductance is slightly greater than rather than far greater than the capacitance.

Further, referring to the embodiment shown in FIG. 3, the half-bridge driver 22 uses a common switch tube driver of a FD2204 model, which is controlled by the MCU controller 21 in a PWM manner, to respectively emit a high level/low level alternately through a third I/O port and a tenth I/O port based on a pulse width of PWM, to drive turn-on times of the switch tube Q1 and the switch tube Q2, so as to control oscillation of the LCC oscillator 24.

In the foregoing detailed control step, an LCC inversion process is symmetrical. Correspondingly, the MCU controller 21 sends a PWM control signal with a duty cycle of 50% to the half-bridge driver 22, to drive the half-bridge 23 to perform switching in this manner.

Further, referring to FIG. 2, to accurately detect the oscillation frequency of the LCC oscillator 24, the circuit 20 further includes an active differential unit 25. A process of using the active differential unit 25 for detection includes:

based on a feature that an oscillation voltage gradually reaches a maximum value and the current gradually becomes 0, first detecting a change rate/calculating a derivative of the oscillation voltage of the LCC oscillator 24;

comparing the change rate or the derivative of the voltage with a preset threshold, and outputting a pulse type interrupt signal to the MCU controller 21 when the change rate or the derivative is greater than the preset threshold; and obtaining, by the MCU controller 21, the oscillation frequency of the LCC oscillator 24 according to an interval of the received interrupt signal.

An implementation of the foregoing specific processes is implemented based on three submodules of the active differential unit 25 shown in FIG. 3, which specifically include:

a signal access module, including a diode D1, a resistor R2, a resistor R3, and a voltage stabilizing tube Z, where the diode D1 allows access of voltages in a positive half waveform of the LCC oscillator 24 and filters voltages in a negative half waveform, and the resistor R2 and the resistor R3 performs voltage division; and Z is a voltage stabilizing tube, configured to prevent an excessively large input voltage to protect a post-stage circuit;

an active differential module, where a conventional active differential circuit including standard basic components is used in FIG. 3, and the active differential module includes an operational amplifier U1, a capacitor C3, a resistor R4, a resistor R5, a resistor R6, a capacitor C4, and a resistor R6, where the operational amplifier U1, the capacitor C3, and the resistor R4 are basic necessary components forming the active differential module; a ratio of the resistor R4 to a resistor R7 is 1, to prevent a high spike in outputs, so that the circuit has a flattest amplitude-frequency response reduce Q value; the capacitor C4 is configured to stabilize a voltage, to prevent self-excited oscillation of the operational amplifier;

a voltage signal Vout outputted by the active differential module during working is:

$$\text{V out} = -R6 \cdot C3 \cdot \left[\frac{d}{dt}\left(\frac{R3}{R2+R3} \cdot \text{PP_LCC}\right)\right] + \frac{R6 \cdot 2.5}{R5+R6},$$

where in the formula, PP_LCC is a resonant voltage of the LCC oscillator 24; and according to the principle of the calculation formula, an output result is a result of performing comprehensive operation on a derivative of the resonant voltage of the LCC oscillator 24 to a time t and parameters of related devices in the active differential module, where the parameters of the related devices are known and given, so that the output result may be equal to the derivative of the voltage to the time, namely, a change rate of the voltage; and a comparison output module, which is mainly a comparator U2 in FIG. 3, and configured to output a high level when Vout outputted by the active differential module is greater than a preset threshold.

Figure 8:
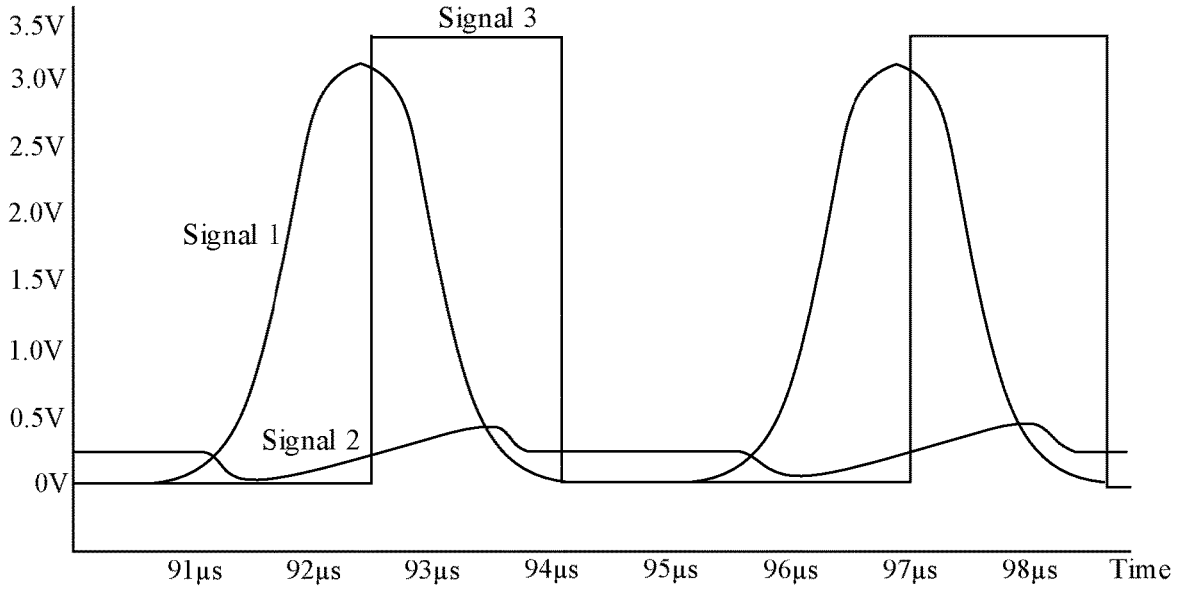
FIG. 8 is a schematic diagram of signal changes in three stages of an active differential unit.

For ease of understanding of a person skilled in the art, FIG. 8 is a schematic diagram of signal changes in three stages of a detected active differential unit 25 according to an embodiment, where a signal 1 is a graph of a voltage signal at a site between the resistor R2 and the resistor R3 of the signal access module;

a signal 2 is a graph of the voltage signal Vout outputted by the operational amplifier U1 of the active differential module; and a signal 3 is a graph of a pulse type square wave outputted by the comparator U2 through comparison.

It should be noted that, according to the calculation formula of the outputted voltage signal Vout, the signal 2 in FIG. 8 is negatively correlated with the signal 1. That is, in an ascending process of the signal 1, an output of the signal 2 is a negative value, and the signal 2 is 0 when the signal 1 reaches a peak; and during a descending process of the signal 1 from the peak, the output of the signal 2 is a positive value. However, the active differential module cannot output a negative signal, so that a reference value is added to the operation result to cause the output of the signal 2 to be always a positive value. The comparator U2 uses the reference value as a comparison basis, and when the signal 2 is increased continuously after being higher than the reference value, it indicates that the signal 1 is in the descending process staring from the peak; and the comparator outputs a low level after the descending process ends. According to the foregoing descriptions, in the formula, a signal value R6*2.5/(R5+R6) outputted when the signal 1 reaches the peak, that is, when the change rate of the voltage is 0, is used as a reference value of a reference input end of the comparator U2.

According to the above, during implementations, the MCU controller 21 does not need to actively perform high-frequency sampling to obtain the oscillation frequency of the LCC oscillator 24. It is only required to transmit the pulse square wave of the signal 3 as an interrupt signal to the MCU controller 21, and the MCU controller 21 obtains the frequency by calculating an interval (namely, a period) of adjacent square waves after receiving the signal. The electrical term "interrupt signal" is a control manner of a chip or a device such as a single-chip microcomputer. Specifically, when a CPU or a receiving process receives the "interrupt signal", another process or task is stopped temporarily, and after a function or a process corresponding to the "interrupt signal" is completed at a proper moment, the original process or task is returned.

According to the foregoing manner, the active differential module 25 detects the change rate or the derivative of the voltage of the LCC oscillator 24, generates a square wave having a same frequency through comparison operation, and transmits the square wave as an interrupt signal to the MCU controller 21. The MCU controller 21 obtains the frequency by calculating an interval (namely, a period) of adjacent square waves after receiving the signal.

In another variant implementation, the LCC oscillator 24 may be replaced with a series LC oscillator using a same symmetrical resonance structure. Oscillation processes of the LCC oscillator and the series LC oscillator are all performed by using a duty cycle of 50% and the oscillators all output a symmetrical sine or cosine variable voltage or current. In addition, turn-on and turn-off switching of the oscillators are performed based on a zero current topology technology. A frequency of the series LC oscillator may be tracked by using the active differential unit 25 for ease of control and adjustment.

Figure 9:
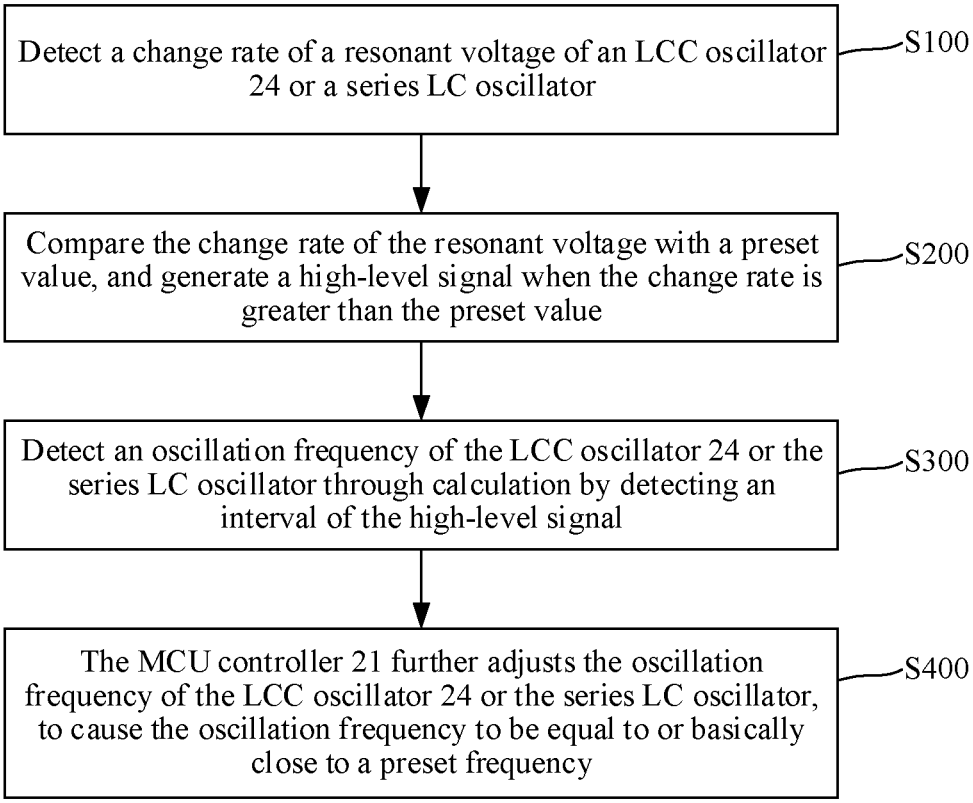
FIG. 9 is a schematic diagram of an aerosol generation device control method according to an embodiment.

Another embodiment of this application further provides an aerosol generation device control method, and the aerosol generation device uses the LCC oscillator 24 or adjacent series LC oscillators to drive the susceptor 30 to generate heat. FIG. 9 shows steps of the method, and the steps are as follows:

S100. Detect a change rate of an oscillation voltage of the LCC oscillator 24 or the series LC oscillator.

S200. Compare the change rate of the oscillation voltage with a preset value, and generate a high-level signal when the change rate is greater than the preset value.

S300. Detect an oscillation frequency of the LCC oscillator 24 or the series LC oscillator through calculation by detecting an interval of the high-level signal.

S400. The MCU controller 21 further adjusts the oscillation frequency of the LCC oscillator 24 or the series LC oscillator, to cause the oscillation frequency to be equal to or basically close to a preset frequency.

The frequency is detected through tracking and is adjusted in real time, so that the oscillation frequency is equal to or basically close to the preset frequency, thereby improving the efficiency as much as possible.

It should be noted that, the specification of this application and the accompanying drawings thereof illustrate preferred embodiments of this application, but are not limited to the embodiments described in this specification. Further, a person of ordinary skill in the art may make improvements or modifications according to the foregoing descriptions, and all the improvements and modifications shall fall within the protection scope of the appended claims of this application.

What is claimed is:

1. An aerosol generation device, configured to heat an aerosol generation product to generate aerosols for inhalation, and comprising:

a susceptor, configured to be penetrated by a variable magnetic field to generate heat, to heat the aerosol generation product;

a series LC oscillator or a series LCC oscillator comprising an inductance coil, configured to guide a variable alternating current to flow through the inductance coil to drive the inductance coil to generate the variable magnetic field; and a circuit, configured to determine an oscillation frequency of the series LC oscillator or the series LCC oscillator according to a change rate of an oscillation voltage of the series LC oscillator or the series LCC oscillator.

2. The aerosol generation device according to claim 1, wherein the circuit comprises:

an active differential unit, configured to detect the change rate of the oscillation voltage of the series LC oscillator or the series LCC oscillator, and output a high-level signal when the change rate of the oscillation voltage is greater than a preset threshold; and a controller, configured to determine the oscillation frequency of the series LC oscillator or the series LCC oscillator according to an interval of the high-level signal.

3. The aerosol generation device according to claim 2, wherein the active differential unit comprises: an active differential module and a comparator, wherein the active differential module is configured to detect the change rate of the oscillation voltage of the series LC oscillator or the series LCC oscillator; and the comparator is configured to perform comparison operation on the change rate of the oscillation voltage and the preset threshold, and output the high-level signal to the controller when the change rate of the oscillation voltage is greater than the preset threshold.

4. The aerosol generation device according to claim 3, wherein the active differential module comprises: a first capacitor, a first resistor, a second capacitor, a second resistor, and an operational amplifier, wherein a first end of the first capacitor is connected to the series LC oscillator or the series LCC oscillator, and a second end of the first capacitor is connected to a first end of the first resistor;

a first input end of the operational amplifier is connected to a second end of the first resistor, and an output end of the operational amplifier is connected to the comparator;

a first end of the second capacitor is connected to the second end of the first resistor, and a second end of the second capacitor is connected to the output end of the operational amplifier; and a first end of the second resistor is connected to the second end of the first resistor, and a second end of the second resistor is connected to the output end of the operational amplifier.

5. The aerosol generation device according to claim 4, wherein the preset threshold is an output value of the active differential module when the change rate of the oscillation voltage is 0.

6. The aerosol generation device according to claim 4, wherein the controller is configured to adjust the oscillation frequency of the series LC oscillator or the series LCC oscillator, to cause the oscillation frequency of the series LC oscillator or the series LCC oscillator to be equal to a preset frequency.

7. The aerosol generation device according to claim 3, wherein the active differential unit further comprises:

an access module, comprising a first diode, a third resistor, and a fourth resistor, wherein a first end of the first diode is connected to the series LC oscillator or the series LCC oscillator, and a second end of the first diode is connected to a first end of the third resistor and is configured to only allow a current to flow from the series LC oscillator or the series LCC oscillator to the third resistor;

a second end of the third resistor is connected to the active differential module; and a first end of the fourth resistor is connected to the second end of the third resistor, and a second end of the fourth resistor is connected to ground.

8. The aerosol generation device according to claim 7, wherein the access module further comprises a voltage stabilizing tube, wherein a first end of the voltage stabilizing tube is connected to the second end of the third resistor, and a second end of the voltage stabilizing tube is connected to the second end of the fourth resistor.

9. The aerosol generation device according to claim 8, wherein the preset threshold is an output value of the active differential module when the change rate of the oscillation voltage is 0.

10. The aerosol generation device according to claim 8, wherein the controller is configured to adjust the oscillation frequency of the series LC oscillator or the series LCC oscillator, to cause the oscillation frequency of the series LC oscillator or the series LCC oscillator to be equal to a preset frequency.

11. The aerosol generation device according to claim 7, wherein the preset threshold is an output value of the active differential module when the change rate of the oscillation voltage is 0.

12. The aerosol generation device according to claim 7, wherein the controller is configured to adjust the oscillation frequency of the series LC oscillator or the series LCC oscillator, to cause the oscillation frequency of the series LC oscillator or the series LCC oscillator to be equal to a preset frequency.

13. The aerosol generation device according to claim 3, wherein the preset threshold is an output value of the active differential module when the change rate of the oscillation voltage is 0.

14. The aerosol generation device according to claim 3, wherein the controller is configured to adjust the oscillation frequency of the series LC oscillator or the series LCC oscillator, to cause the oscillation frequency of the series LC oscillator or the series LCC oscillator to be equal to a preset frequency.

15. The aerosol generation device according to claim 2, wherein the controller is configured to adjust the oscillation frequency of the series LC oscillator or the series LCC oscillator, to cause the oscillation frequency of the series LC oscillator or the series LCC oscillator to be equal to a preset frequency.

16. An aerosol generation device control method, the aerosol generation device comprising:

a susceptor, configured to be penetrated by a variable magnetic field to generate heat, to heat an aerosol generation product; and a series LC oscillator or a series LCC oscillator comprising an inductance coil, configured to guide a variable alternating current to flow through the inductance coil to drive the inductance coil to generate the variable magnetic field;

and the method comprising:

detecting a change rate of an oscillation voltage of the series LCC oscillator or the series LC oscillator;

generating a high-level signal when the change rate of the oscillation voltage is greater than a preset value; and determining an oscillation frequency of the series LCC oscillator or the series LC oscillator according to an interval of the high-level signal.

17. The aerosol generation device control method according to claim 16, further comprising:

adjusting the oscillation frequency of the series LC oscillator or the series LCC oscillator, to cause the oscillation frequency of the series LC oscillator or the series LCC oscillator to be equal to a preset frequency.

* * * * *